US009402449B1

(12) United States Patent
Kim

(10) Patent No.: US 9,402,449 B1
(45) Date of Patent: Aug. 2, 2016

(54) FASTENER FOR ANGLE-ADJUSTABLE EARRING

(71) Applicant: Rex Diamond Co., Ltd., Seoul (KR)

(72) Inventor: Won Ku Kim, Seoul (KR)

(73) Assignee: Rex Diamond Co., Ltd., Seoul (KR)

( * ) Notice: Subject to any disclaimer, the term of this patent is extended or adjusted under 35 U.S.C. 154(b) by 0 days.

(21) Appl. No.: 14/812,957

(22) Filed: Jul. 29, 2015

(30) Foreign Application Priority Data

Jan. 16, 2015 (KR) ..... 10-2015-0008024

(51) Int. Cl.
*A44C 7/00* (2006.01)

(52) U.S. Cl.
CPC . *A44C 7/003* (2013.01); *Y10T 24/41* (2015.01)

(58) Field of Classification Search
CPC ..... A44C 7/00; A44C 7/003; A44C 7/006; A44C 7/008; Y10T 24/41; Y10T 70/8757; Y10T 24/366; Y10T 24/45832; Y10T 24/46
See application file for complete search history.

(56) References Cited

U.S. PATENT DOCUMENTS 271,121 A * 1/1883 Riley ..... A44C 7/00 63/12
978,789 A * 12/1910 Stern ..... A44C 7/003 24/705
995,744 A * 6/1911 Watkins ..... A44B 9/10 24/707.3
2,708,128 A * 5/1955 Arzt ..... A44C 7/008 63/14.7
2,858,679 A * 11/1958 Moreschi ..... A44C 7/008 606/188
2,869,338 A * 1/1959 Norgaard ..... A44C 7/00 606/188
2,961,854 A * 11/1960 Kettell ..... A44C 7/008 269/249
4,003,217 A * 1/1977 Evans ..... A44C 7/00 63/12
4,292,715 A * 10/1981 Huddon ..... A44C 7/00 24/705
4,631,929 A * 12/1986 Hollingworth ..... A44C 7/003 24/108
4,869,078 A * 9/1989 Leith ..... A44C 7/002 63/13
6,138,333 A * 10/2000 Hollingworth ..... A44C 7/003 24/108

FOREIGN PATENT DOCUMENTS

KR 20-0420445 Y1 7/2006
KR 20-2011-0004083 U 4/2011

* cited by examiner

*Primary Examiner* — Robert J Sandy
*Assistant Examiner* — David Upchurch
(74) *Attorney, Agent, or Firm* — Novick, Kim & Lee, PLLC

(57) ABSTRACT

Provided is a fastener for an angle-adjustable earring. The fastener includes: a housing has a hollow box shape with an open front end; a latch member received in the housing; a pin member fixed to the latch member and inclined at a predetermined angle with respect to the latch member; a control member having a protrusion that controls a position of the latch member that is locked; an elastic member that elastically supports the control member; and a cap member having a slide hole, the cap member being attached to the open front end of the housing in a state in which the elastic member, control member, and latch member are installed in the housing, in which the pin member extends from the latch member to the outside of the housing through the slide hole so that an angle of the pin member is adjustable.

9 Claims, 6 Drawing Sheets

FASTENER FOR ANGLE-ADJUSTABLE EARRING

BACKGROUND OF THE INVENTION

1. Field of the Invention

The present invention generally relates to a fastener for an angle-adjustable earring and, more particularly to a fastener for an angle-adjustable earring, the fastener being capable of improving appearance of an earring by allowing an angle of an earring that is attached to a wearer's earlobe via the fastener to be adjusted according to a tilted angle of the wearer's earlobe and to characteristics of the design of an earring.

2. Description of the Related Art

Earrings are popular and are commonly worn by women, but nowadays earrings are being increasingly worn by men as well. That is, in modern times men also wear earrings to express their personality. Earrings take various forms and are made of various materials, for example, precious metals.

By and large, earrings are attached to a wearer's ears in two ways.

First, some earrings (clip-on earrings or ear-screws) are clipped to or screwed onto a wearer's earlobes. These earrings have the disadvantage causing pain to a wearer because the wearer's earlobes are pressed by the clips or screws.

Some earrings (for example, body piercings) are pierced through the earlobes. This earring attachment method has the advantage of not causing pain to a wearer when the earrings are worn.

However, piercing-type earrings have a problem that their appearance changes according to their attachment angles to a wearer's earlobes. This is because people have different shapes of earlobes. Specifically, an angle of an earlobe that is tilted with respect to an imaginary plane of a wearer's face may vary person to person when viewed from the wearer's frontal face. For this reason, when piercing-type earrings are worn, the shape of the piercing-type earring looks different according to viewing angles or tilt angles of the piercing-type earring.

For example, ring-shaped earrings look most beautiful when they are attached to the earlobes in a posture in which they are perpendicular to the ground so that they look to have a perfect ring shape when viewed from the wearer's side face and look to have a linear vertical bar shape when viewed from the wearer's frontal face.

When conventional piercing-type earrings are attached to earlobes, pins of the piercing-type earrings are inserted into holes that are formed to be perpendicular to the wearer's earlobes. Generally, the earlobes of human ears are inclined at 45° to 70° with respect to the anterior-posterior direction of the head.

Therefore, when a pair of ring-shaped earrings is worn at a right angle to the earlobes, the worn earrings are not parallel to each other. As illustrated in FIG. 10, the front parts of the earrings are directed to be diverged from each other when viewed from the wearer's frontal face and the earrings look to have an oval shape when viewed from the wearer's side face.

On the other hand, earrings are usually designed such that they look the most beautiful when they are viewed from the wearer's frontal face.

However, conventional earrings are difficult to be attached to wearer's earlobes at optimum angles at which the earrings look most beautiful. Therefore, it has been difficult to express the unique design characteristics of earrings when the earrings are worn by wearers.

DOCUMENTS OF RELATED ARTS

Patent Documents (Patent Document 1) Korean Utility Model Registration No. 20-0420445 (registered on Jun. 26, 2006)

(Patent Document 2) Korean Utility Model Application Publication No. 20-2011-0004083 (Published on Apr. 27, 2011)

SUMMARY OF THE INVENTION

Accordingly, the present invention has been made keeping in mind the above problems occurring in the prior art, and an object of the present invention is to provide a fastener for an angle-adjustable earring that can adjust an angle between an earring and an earlobe when the earring is attached to the earlobe, thereby improving appearance of an earring that is worn by a wearer.

Another object of the present invention is to provide a fastener for an angle-adjustable earring that enables an earring to express its design characteristics.

A further object of the present invention is to provide a fastener for an angle-adjustable earring that can improve reliability and marketability of an earring.

In order to accomplish the objects of the invention, according to one aspect, there is provided a fastener for an angle-adjustable earring, including: a housing having a hollow box shape with an opening at a front end thereof and being fixed to an end of an earring at a remaining end thereof; a latch member received in the housing; a pin member fixed to one end of the latch member, inclined at a predetermined angle with respect to the latch member, and installed to extend outside housing from the end of the latch member; a control member having a protrusion that controls a position of the latch member that is locked; an elastic member that elastically supports the control member in the housing; and a cap member having a slide hole, the cap member being attached to the opening of the housing in a state in which the elastic member, the control member, and the latch member are installed in the housing, wherein the pin member extends from the latch member to the outside of the housing through the slide hole so that an angle of the pin member is adjustable.

The elastic member may be a coil spring.

In order to accomplish the objects of the invention, according to one aspect, there is provided a fastener for an angle-adjustable earring, including: a housing having a hollow box shape with an opening at a front end thereof and being fixed to an end of an earring at a remaining end thereof and; a latch member received in the housing; a pin member fixed to one end of the latch member, inclined at a predetermined angle with respect to the latch member, and installed to extend outside housing from the end of the latch member; a leaf spring member having a locking portion that is a bent portion of the leaf spring and that maintains a position of the latch member that is locked, the leaf spring member elastically supporting a control member; and a cap member having a slide hole, the cap member being attached to the opening of the housing in a state in which the elastic member, the control member, and the latch member are installed in the housing, wherein the pin member extends from the latch member to the outside of the housing through the slide hole so that an angle of the pin member is adjustable.

The housing may be provided with a recess and the cap member is provided with a hook that extends inward from an end of an arm, and wherein the hook is hooked in the recess so that the housing and the cap member are combined with each other.

The latch member and the housing may be provided with a shaft hole and a hinge hole, respectively; a shaft is inserted in the shaft hole; and the latch member and the pin member are assembled with the shaft so that the latch member and the pin member are rotated about the shaft.

The latch member may be provided with two or more steps of control recesses.

According to the present invention, it is possible to adjust an attachment angle of an earring with respect to a wearer's earlobe.

Accordingly, the present invention improves appearance of earrings and helps design characteristics of earrings best exhibited, thereby increasing reliability and marketability of an earring.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinafter, preferred embodiments of the present invention will be described in detail with reference to the accompanying drawings.

An earring 1 is a piercing-type earring that is worn in a manner that a hole is punched in a wearer's earlobe 2 and a pin member 30 of the earring 1 is inserted into the hole. An attachment angle of the earring 1 worn by a wearer can be adjusted. This earring may have a ring shape that is not excessively thin but has uniform thickness and width.

Figure 1:
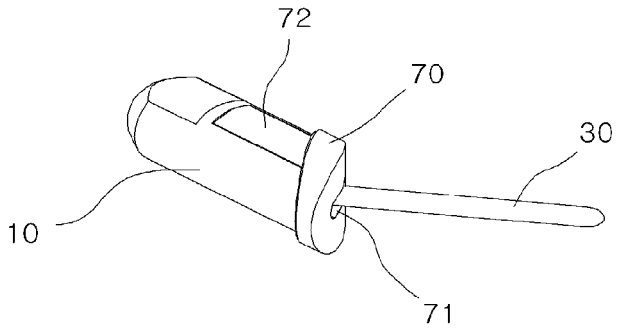
FIG. 1 is a perspective view illustrating a fastener for an angle-adjustable earring according to one embodiment of the present invention.
Figure 2:
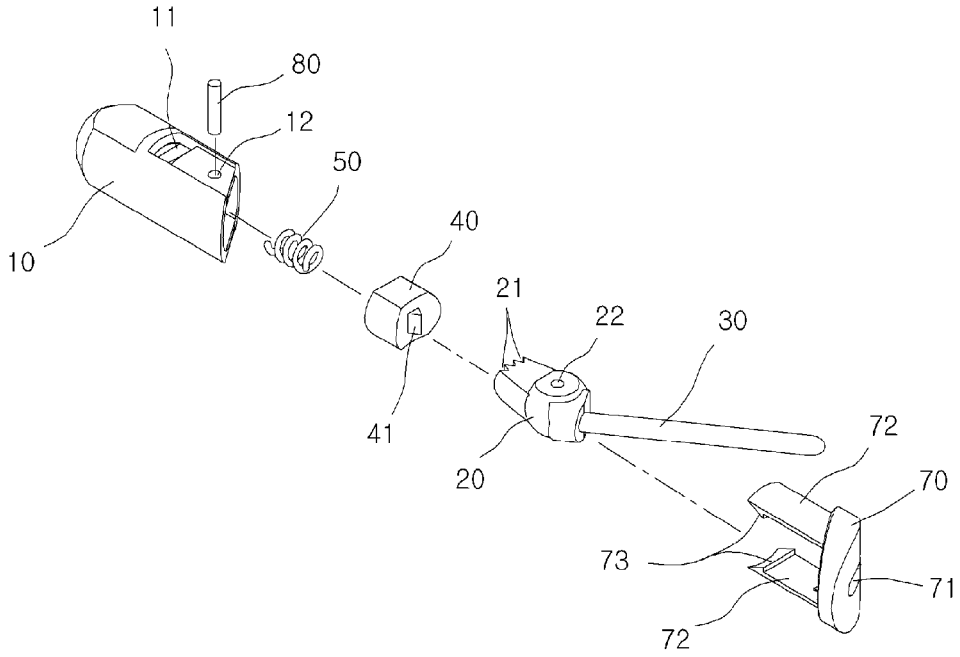
FIG. 2 is an exploded perspective view illustrating a main part of the fastener for an angle-adjustable earring according to the embodiment of the present invention.
Figure 3:
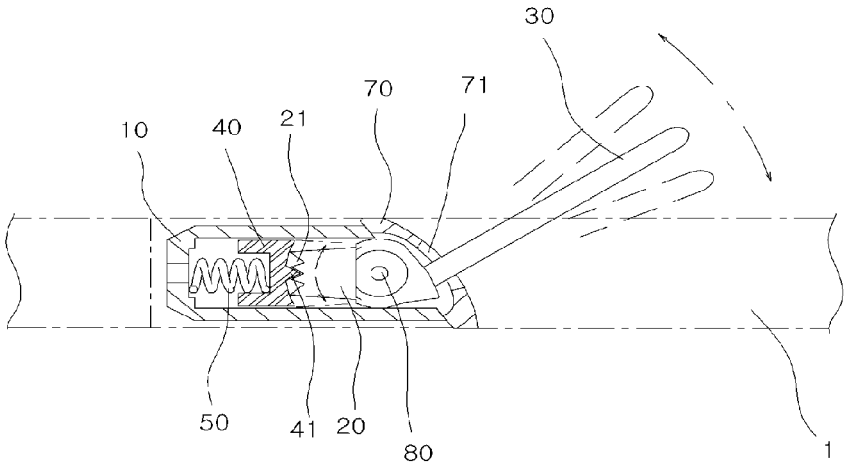
FIG. 3 is a cross-sectional view of the fastener for an angle-adjustable earring according to one embodiment of the present invention.
Figure 4:
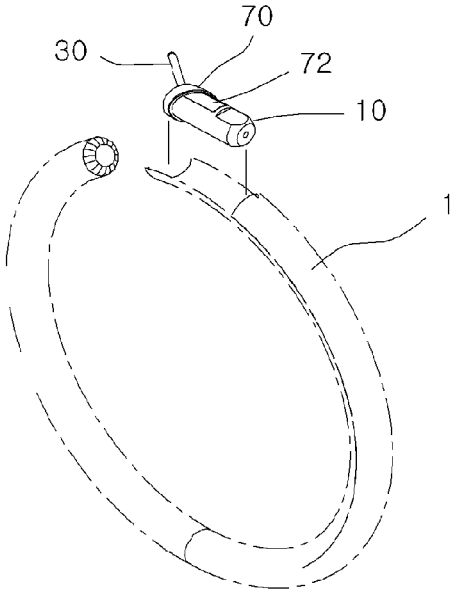
FIG. 4 is a perspective view illustrating a state in which an earring to which the fastener according to the one embodiment of the invention is applied is attached to an earlobe.
Figure 5:
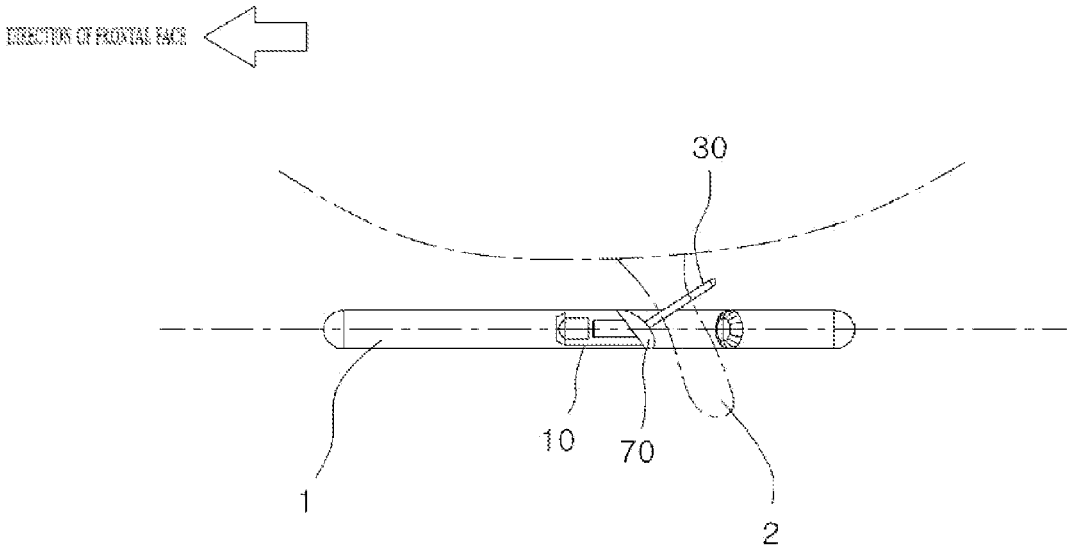
FIG. 5 is a plan view illustrating a state in which an earring to which the fastener for an angle-adjustable earring according to the embodiment of the present invention is applied is about to be attached to an earlobe.

In order to attach the earring 1 to an earlobe 2, as illustrated in FIG. 3, an angle-adjustable fastener according to one embodiment of the invention is fixed to an end of the earring 1 through welding or via an adhesive.

The fastener includes a housing 10 having a hollow box shape and an opening at a front end thereof. A cap member 70 is attached to the open front end of the housing 10 to prevent members installed inside the housing 10 from being removed or separated from the housing.

A latch member 20 is installed inside the housing 10 and a pin member 30 is fixed to a front end of the latch member 20.

A thin bar-like pin member 30 may be separately manufactured and fixed to the latch member 20 through welding. Alternatively, the pin member 30 and the latch member 20 may be unified.

The pin member 30 and the latch member 20 are installed in the housing 10 in a state in which the pin member 30 is inclined at a predetermined angle with respect to the center of the earring 1. An angle between the center of the body of the earring 1 and the pin member 30 can be adjusted according to user's choice.

A control member 40 has a protrusion 41. An end of the latch member 20 may be locked on or under the protrusion 41. The control member 40 is elastically supported in the housing 10 by an elastic member 50.

The protrusion 41 of the control member 40 is always in contact with the latch member 20 due to the elastic force of the elastic member 50. When a user moves the pin member 30, the elastic member 50 contracts and the control member 40 retreats, so that the end of the latch member 20 moves from the upper side to the underside of the protrusion 41 or from the underside to the upper side of the protrusion 41. Then, the position of the end of the latch member 20 may be maintained on or under the protrusion 41.

The opening of the housing 10 is closed by the cap member 70 in a state in which the elastic member 50, the control member 40, and the latch member 20 are installed in the housing 10 so that parts installed in the housing 10 will not be removed or separated from the housing 10.

The cap member 70 has a slide hole 71 that extends in a left-and-right direction of the cap member 70. The pin member 30 is assembled with the cap member 70 such that the pin member 30 passes through the slide hole 71. The pin member 30 moves left and right along the slide hole 71 so that the angle of the pin member can be changed.

The elastic member 50 may be a coil spring.

Figure 8:
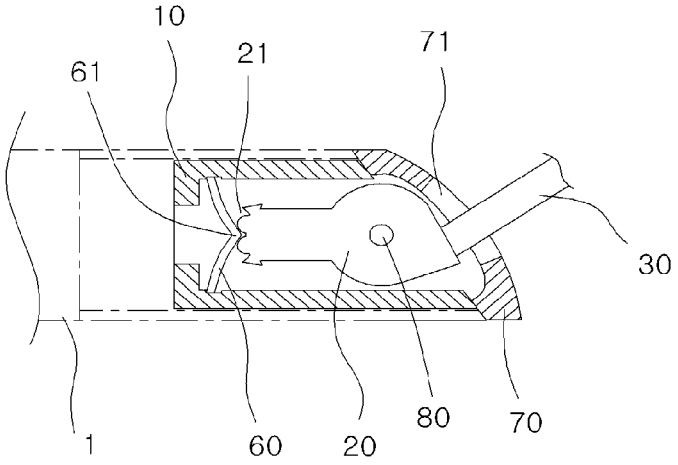
FIGS. 8 and 9 are plan views illustrating angle changes of a pin member in a fastener for an angle-adjustable earring according to another embodiment of the present invention.
Figure 9:
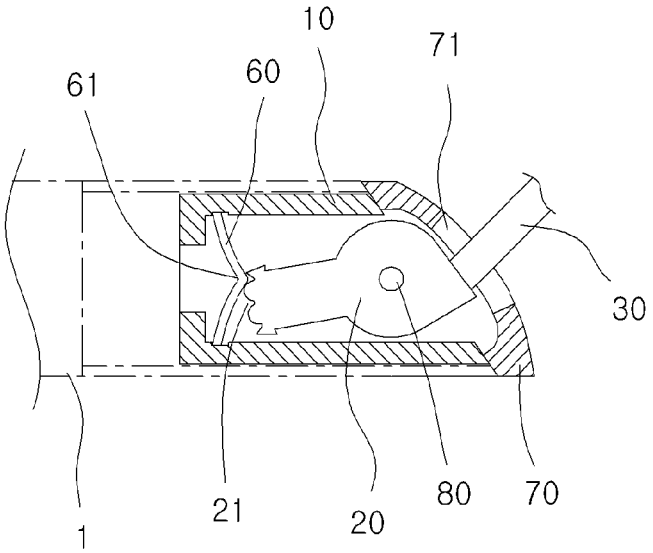

FIGS. 8 and 9 illustrate a fastener for an angle-adjustable earring according to another embodiment of the present invention. As illustrated in FIGS. 8 and 9, a leaf spring member 60 functions as both the control member 40 and the elastic member 50. Therefore, the position of a latch member 20 that is locked is controlled by the leaf spring member 60.

The leaf spring member 60 may be a leaf sprig having strong elasticity. The leaf spring member 60A has a bent portion 61 serving as a locking portion 61 that locks the latch member 20. In the housing 10, the leaf spring member 60 elastically supports the latch member 20 and controls the position of the latch member 20.

A combining member that combines the housing 10 with the cap member 70 may be a recess 11 formed in the housing 10 and a hook 73 which extends inward from an end of an arm 72 of the cap member 70. The hook 73 is hooked in the recess 11 so that the housing 10 and the cap member 20 can be combined with each other.

The arms 72 extend in parallel with each other from upper and lower ends of the cap member 70 and have elasticity. Therefore, when the hook 73 is hooked in the recess 11, the firmly hooked state can be maintained.

The arms 72 can be removed as necessary by forcing the arms 72 open.

The latch member 20 is installed such that it is housed in the housing 10 and is in contact with the inside surface of the cap member 70. Therefore, the latch member 20 is not removed from the housing 10 and pivoting motion of the latch member 20 is guided in the housing 10.

The latch member 20 and the housing 10 are provided with a shaft hole 12 and a hinge hole 22, respectively. Preferably, a shaft 80 is inserted in the shaft hole 12 and the latch member 20 and the pin member 30 are assembled with the shaft 80 so that the latch member 20 and the pin member 30 are rotated about the shaft 80.

Figure 6:
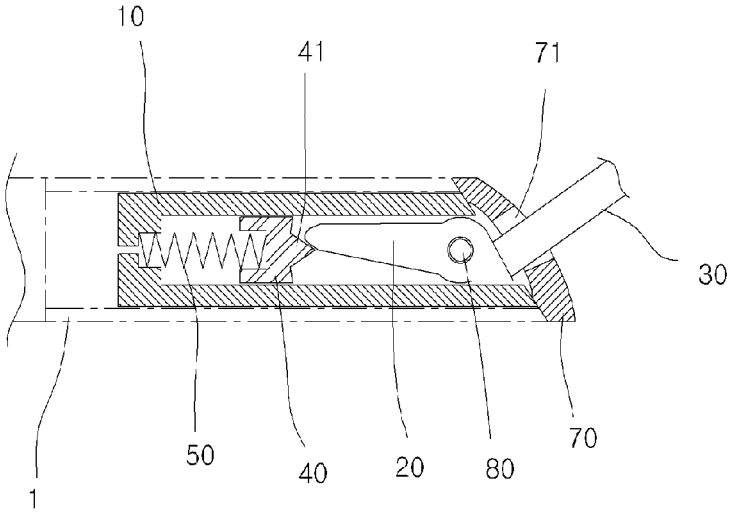
FIG. 6 is a cross-sectional view illustrating a latch member in the fastener for an angle-adjustable earring according to the embodiment of the present invention.
Figure 7:
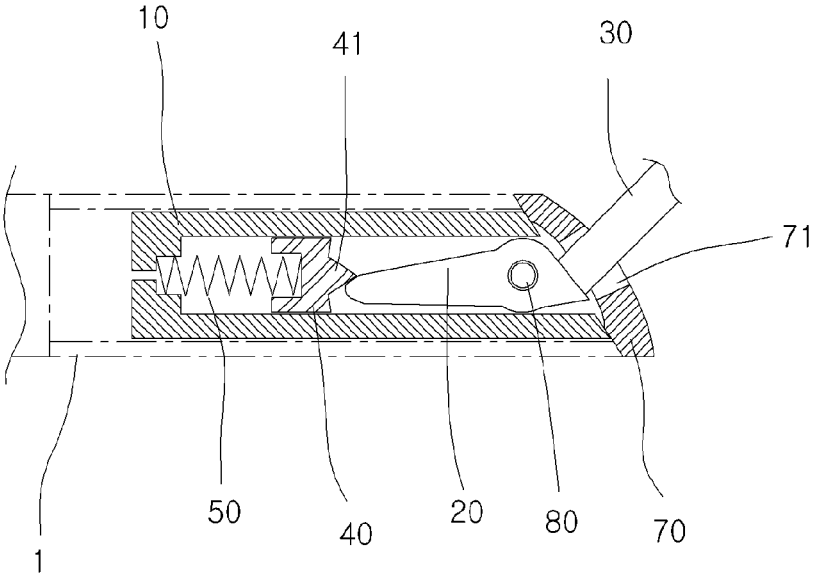
FIG. 7 is a cross-sectional view illustrating a state in which an angle of a pin member engaged with the latch member is changed from the state of FIG. 6.

As illustrated in FIGS. 6 and 7, the latch member 20 is a bar-like member with a rounded end portion. The end portion is locked on or under the protrusion 41 of the control member 40. In this way, an angle of the pin member 30 is changed in two steps.

The latch member 20 may have two or more steps of control recesses 21.

For example, as illustrated in FIG. 3, the latch member 20 is provided with three control recesses 21 so that the angle of the pin member can be changed in three steps according to in which step of control recess 21 the protrusion 41 of the control member 40 is positioned.

In addition, as illustrated in FIGS. 8 and 9, the latch member 20 is provided with three control recesses 21 and the angle of the pin member can be changed in three steps according to in which step of control recess 21 the locking portion 61 of the leaf spring member 60 is positioned.

The fastener according to the embodiment of the present invention is fixed to one end of the earring 1 in a state in which an angle of the pin member 30 can be adjusted in two or more steps, so that the earring 1 is attached to an earlobe in a manner that it is inserted through a hole that is already formed in the earlobe.

Human earlobes are mostly tilted at an angle of from 20° to 70° with respect to the anterior-posterior direction of the head (i.e. viewing direction of a viewer in front of an earring wearer).

Figure 10:
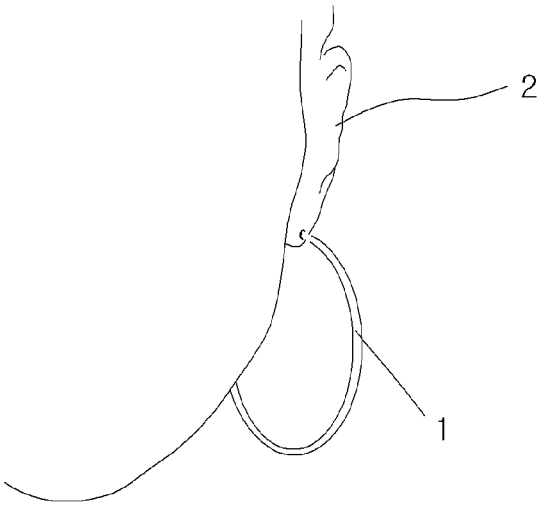
FIG. 10 is a front view of a conventional earring that is attached to an earlobe.
Figure 11:
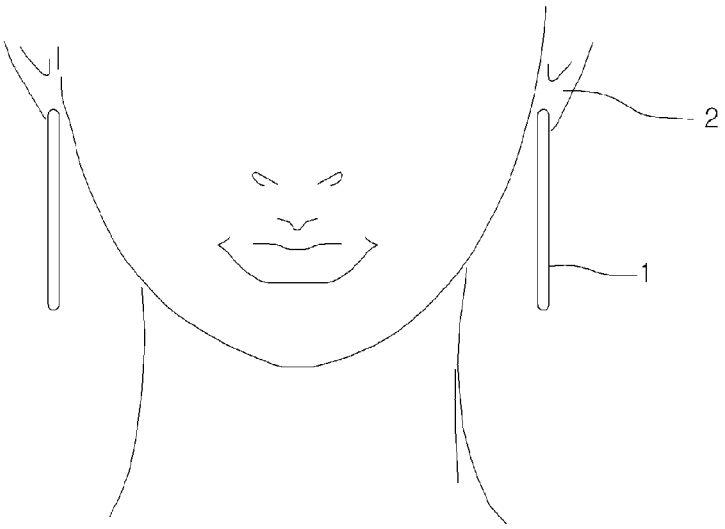
FIG. 11 is a front view of an earring, to which the fastener according to the embodiment of the present invention is applied, worn by a wearer.
Figure 12:
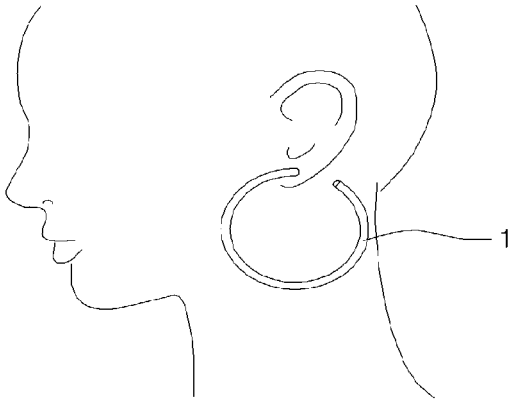
FIG. 12 is a side view of an earring, to which the fastener according to the embodiment of the present invention is applied, worn by a wearer.

Accordingly, as indicated by an imaginary line of FIG. 10, after the earrings are attached to earlobes such that the earrings are perpendicular to the earlobes and thus are not parallel to each other, the directions of the earrings are adjusted according to the tilted angles of the wearer's earlobes so that the earrings are in parallel with each other and are positioned to face the front direction (viewing direction). The directions of the earrings can be adjusted by adjusting angles of the pin members 30.

As a result, the earrings are positioned to look most beautiful when they are worn, and design characteristics of the earrings can be best expressed.

Although a preferred embodiment of the present invention has been described for illustrative purposes, those skilled in the art will appreciate that various modifications, additions and substitutions are possible, without departing from the scope and spirit of the invention as disclosed in the accompanying claims.

The present invention applies to a technology of a fastener. Specifically, the present invention may apply to the field of earring whose attachment angles can be adjusted according to tilt angles of earlobes or design of the earrings.

What is claimed is:

1. A fastener for an angle-adjustable earring, comprising:

a housing having a hollow box shape with an opening at a front end thereof and configured to be fixed to an end of the earring at a remaining end thereof;

a latch member received in the housing;

a pin member fixed to an end of the latch member, inclined at a predetermined angle with respect to the latch member, and installed to extend outside housing from the end of the latch member;

a control member having a protrusion that controls a position of the latch member that is locked;

an elastic member that elastically supports the control member in the housing; and a cap member having a slide hole, the cap member being attached to the opening of the housing in a state in which the elastic member, the control member, and the latch member are installed in the housing, wherein the pin member extends from the latch member to the outside of the housing through the slide hole so that an angle of the pin member is adjustable.

2. The fastener according to claim 1, wherein the elastic member is a coil spring.

3. A fastener for an angle-adjustable earring, comprising:

a housing having a hollow box shape with an opening at a front end thereof and configured to be fixed to an end of the earring at a remaining end thereof;

a latch member received in the housing;

a pin member fixed to an end of the latch member, inclined at a predetermined angle with respect to the latch member, and installed to extend outside housing from the end of the latch member;

a leaf spring member having a locking portion that is a bent portion of the leaf spring and that maintains a position of the latch member that is locked, the leaf spring member elastically supporting a control member; and a cap member having a slide hole, the cap member being attached to the opening of the housing in a state in which the elastic member, the control member, and the latch member are installed in the housing, wherein the pin member extends from the latch member to the outside of the housing through the slide hole so that an angle of the pin member is adjustable.

4. The fastener according to claim 1, wherein the housing includes a recess and the cap member includes a hook that extends inward from an end of an arm, and wherein the hook is hooked in the recess so that the housing and the cap member are combined with each other.

5. The fastener according to claim 3, wherein the housing includes a recess and the cap member includes a hook that extends inward from an end of an arm, and wherein the hook is hooked in the recess so that the housing and the cap member are combined with each other.

6. The fastener according to claim 1, wherein the latch member and the housing include a shaft hole and a hinge hole, respectively, wherein a shaft is inserted in the shaft hole, and wherein the latch member and the pin member are assembled with the shaft so that the latch member and the pin member are rotated about the shaft.

7. The fastener according to claim 3, wherein the latch member and the housing include a shaft hole and a hinge hole, respectively, wherein a shaft is inserted in the shaft hole, and wherein the latch member and the pin member are assembled with the shaft so that the latch member and the pin member are rotated about the shaft.

8. The fastener according to claim 1, wherein the latch member includes two or more steps of control recesses.

9. The fastener according to claim 3, wherein the latch member includes two or more steps of control recesses.

* * * * *